US007431831B2

(12) United States Patent
Farshid et al.

(10) Patent No.: US 7,431,831 B2
(45) Date of Patent: Oct. 7, 2008

(54) INTEGRATED IN-LINE PRETREATMENT AND HEAVY OIL UPGRADING PROCESS

(75) Inventors: Darush Farshid, Larkspur, CA (US); Bruce Reynolds, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 326 days.

(21) Appl. No.: 11/305,378

(22) Filed: Dec. 16, 2005

(65) Prior Publication Data

US 2007/0138058 A1 Jun. 21, 2007

(51) Int. Cl.
*C10B 57/02* (2006.01)
*C10G 51/02* (2006.01)

(52) U.S. Cl. ..... 208/423; 208/413; 208/78; 208/49; 208/57; 208/59; 208/61; 208/68; 208/85; 208/86; 208/95; 208/210; 208/212; 208/213

(58) Field of Classification Search ..... None
See application file for complete search history.

(56) References Cited

U.S. PATENT DOCUMENTS 3,817,856 A * 6/1974 Aaron et al. ..... 208/213
4,485,008 A * 11/1984 Maa et al. ..... 208/412
4,684,456 A 8/1987 Van Driesen et al.
5,371,308 A * 12/1994 Gosselink et al. ..... 585/251
5,527,473 A * 6/1996 Ackerman ..... 210/767
5,871,638 A * 2/1999 Pradhan et al. ..... 208/422
5,993,644 A 11/1999 Xiao et al.
6,139,723 A * 10/2000 Pelrine et al. ..... 208/422
6,190,542 B1 * 2/2001 Comolli et al. ..... 208/423
6,264,826 B1 7/2001 Xiao et al.
6,270,655 B1 * 8/2001 Ganguli ..... 208/85
6,278,034 B1 8/2001 Espinoza et al.
6,454,932 B1 9/2002 Baldassari et al.
6,660,157 B2 * 12/2003 Que et al. ..... 208/108
6,726,832 B1 * 4/2004 Baldassari et al. ..... 208/59
6,890,423 B2 5/2005 O'Rear (Continued)

OTHER PUBLICATIONS

U.S. Appl. No. 10/938,202, filed on Sep. 10, 2004, entitled "Highly Active Slurry Catalyst Composition", 14 pages.

(Continued)

*Primary Examiner*—Tam M Nguyen
(74) *Attorney, Agent, or Firm*—Penny L. Prater

(57) ABSTRACT

A new residuum full hydroconversion slurry reactor system has been developed that allows the catalyst, unconverted oil, products and hydrogen to circulate in a continuous mixture throughout an entire reactor with no confinement of the mixture. The mixture is partially separated in between the reactors to remove only the products and hydrogen while permitting the unconverted oil and the slurry catalyst to continue on into the next sequential reactor. In the next reactor, a portion of the unconverted oil is converted to lower boiling point hydrocarbons, once again creating a mixture of unconverted oil, products, hydrogen and slurry catalyst. Further hydroprocessing may occur in additional reactors, fully converting the oil. The oil may alternately be partially converted, leaving a highly concentrated catalyst in unconverted oil which can be recycled directly to the first reactor. The slurry reactor system is, in this invention, preceded by an in-line pretreating step, such as hydrotreating or deasphalting. Following the slurry reactor system, fully converted oil may be subsequently hydrofinished for the removal of hetoroatoms such as sulfur and nitrogen.

19 Claims, 1 Drawing Sheet

U.S. PATENT DOCUMENTS 7,150,823 B2 * 12/2006 Mayer et al. ..... 208/251 R

OTHER PUBLICATIONS

U.S. Appl. No. 10/9380,003, filed on Sep. 10, 2004, entitled "Highly Active Slurry Catalyst Composition", 13 pages.

U.S. Appl. No. 10/938,438, filed on Sep. 10, 2004, entitled "Process for Recycling an Active Slurry Catalyst Composition in Heavy Oil Upgrading", 15 pages.

U.S. Appl. No. 10/938,200, filed on Sep. 10, 2004, entitled "Process for Upgrading Heavy Oil Using a Highly Active Slurry Catalyst Composition", 17 pages.

U.S. Appl. No. 10/938,269, filed on Sep. 10, 2004, entitled "Process for Upgrading Heavy Oil Using a Highly Active Slurry Catalyst Composition", 19 pages.

* cited by examiner

INTEGRATED IN-LINE PRETREATMENT AND HEAVY OIL UPGRADING PROCESS

FIELD OF THE INVENTION

The instant invention relates to a process for upgrading heavy oils, in which the feed is pretreated to partially reduce impurities, nitrogen, carbon residuum, asphaltnenes, metals, and sulfur, then is contacted with a slurry catalyst composition in a series of up flow reactors.

BACKGROUND OF THE INVENTION

There is an increased interest at this time in the processing of heavy oils, due to larger worldwide demand for petroleum products. Canada and Venezuela are sources of heavy oils. Processes which result in complete conversion of heavy oil feeds to useful products are of particular interest.

The following patents, which are incorporated by reference, are directed to the preparation of highly active slurry catalyst compositions and their use in processes for upgrading heavy oil:

U.S. Ser. No. 10/938,202 is directed to the preparation of a catalyst composition suitable for the hydro conversion of heavy oils. The catalyst composition is prepared by a series of steps, involving mixing a Group VIB metal oxide and aqueous ammonia to form an aqueous mixture, and sulfating the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed.

U.S. Ser. No. 10/938,003 is directed to the preparation of a slurry catalyst composition. The slurry catalyst composition is prepared in a series of steps, involving mixing a Group VIB metal oxide and aqueous ammonia to form an aqueous mixture and the mixture to form a slurry. The slurry is then promoted with a Group VIII metal. Subsequent steps involve mixing the slurry with a hydrocarbon oil, and combining the resulting mixture with hydrogen gas (under conditions which maintain the water in a liquid phase) to produce the active slurry catalyst.

U.S. Ser. No. 10/938,438 is directed to a process employing slurry catalyst compositions in the upgrading of heavy oils. The slurry catalyst composition is not permitted to settle, which would result in possible deactivation. The slurry is recycled to an upgrading reactor for repeated use and products require no further separation procedures for catalyst removal.

U.S. Ser. No. 10/938,200 is directed to a process for upgrading heavy oils using a slurry composition. The slurry composition is prepared in a series of steps, involving mixing a Group VIB metal oxide with aqueous ammonia to form an aqueous mixture and the mixture to form a slurry. The slurry is then promoted with a Group VIII metal compound. Subsequent steps involve mixing the slurry with a hydrocarbon oil, and combining the resulting mixture with hydrogen gas (under conditions which maintain the water in a liquid phase) to produce the active slurry catalyst.

U.S. Ser. No. 10/938,269 is directed to a process for upgrading heavy oils using a slurry composition. The slurry composition is prepared by a series of steps, involving mixing a Group VIB metal oxide and aqueous ammonia to form an aqueous mixture, and the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed.

SUMMARY OF THE INVENTION

A process for the hydro conversion of heavy oils with a slurry, said process employing at least two up flow reactors in series with a separator in between each reactor, said process comprising the following steps:

(a) combining a heated heavy oil feed and a hydrogen gas to form a mixture;

(b) contacting the mixture at retreating conditions in at least one reactor;

(c) passing the effluent of step (b) to a post-treating separator;

(d) passing products and hydrogen overhead from the post-treating separator and combining bottoms from the post-treating separator with an active slurry catalyst composition to form a mixture;

(e) passing the mixture of step (d) to the bottom of the first reactor, which is maintained at slurry hydro conversion conditions, including elevated temperature and pressure;

(f) removing a vapor stream comprising product, hydrogen, unconverted material and slurry catalyst overhead from the first reactor and passing it to a separator;

(g) in the separator of step (f), removing a vapor stream comprising product and hydrogen overhead to further processing and passing a liquid bottoms stream, comprising unconverted material and slurry catalyst, to the bottom of the second reactor, which is maintained at slurry hydro conversion conditions, including elevated temperature and pressure;

(h) removing a vapor stream comprising product and hydrogen unconverted material and slurry catalyst overhead from the second reactor and passing it to a second separator;

(i) in the second separator, removing a vapor stream comprising products and hydrogen overhead to further processing and passing a liquid bottoms stream, comprising unconverted material and slurry catalyst to further processing.

The slurry upgrading step of this invention converts nearly 98% of a typical feed, vacuum residue to lighter products (in the boiling range below 1000 F). Due to large quantities of impurities such as sulfur, nitrogen, metals, Conradson carbon and aspartames in straight run vacuum residuum, the slurry conversion reactor requires a very high severity. High severity includes high pressure, large reactors, high fresh catalyst make-up rate and relatively high spent catalyst bleed rate. Downstream hydro processing is often required to achieve appropriate product qualities, but it may be avoided or minimized may be avoided by in-line, integrated pre-treatment of the feed prior to slurry hydro processing as in the instant invention.

In-line retreating of feed to slurry hydro cracking will reduce overall capital expenditures for the slurry hydro cracking processes of this invention. It will also improve product qualities and produce more valuable products.

BRIEF DESCRIPTION OF THE FIGURE

The FIGURE depicts a process scheme of this invention which employs a fixed bed retreating reactor upstream of three reactors employing a catalyst slurry, within the same process loop.

DETAILED DESCRIPTION OF THE INVENTION

Figure 1:
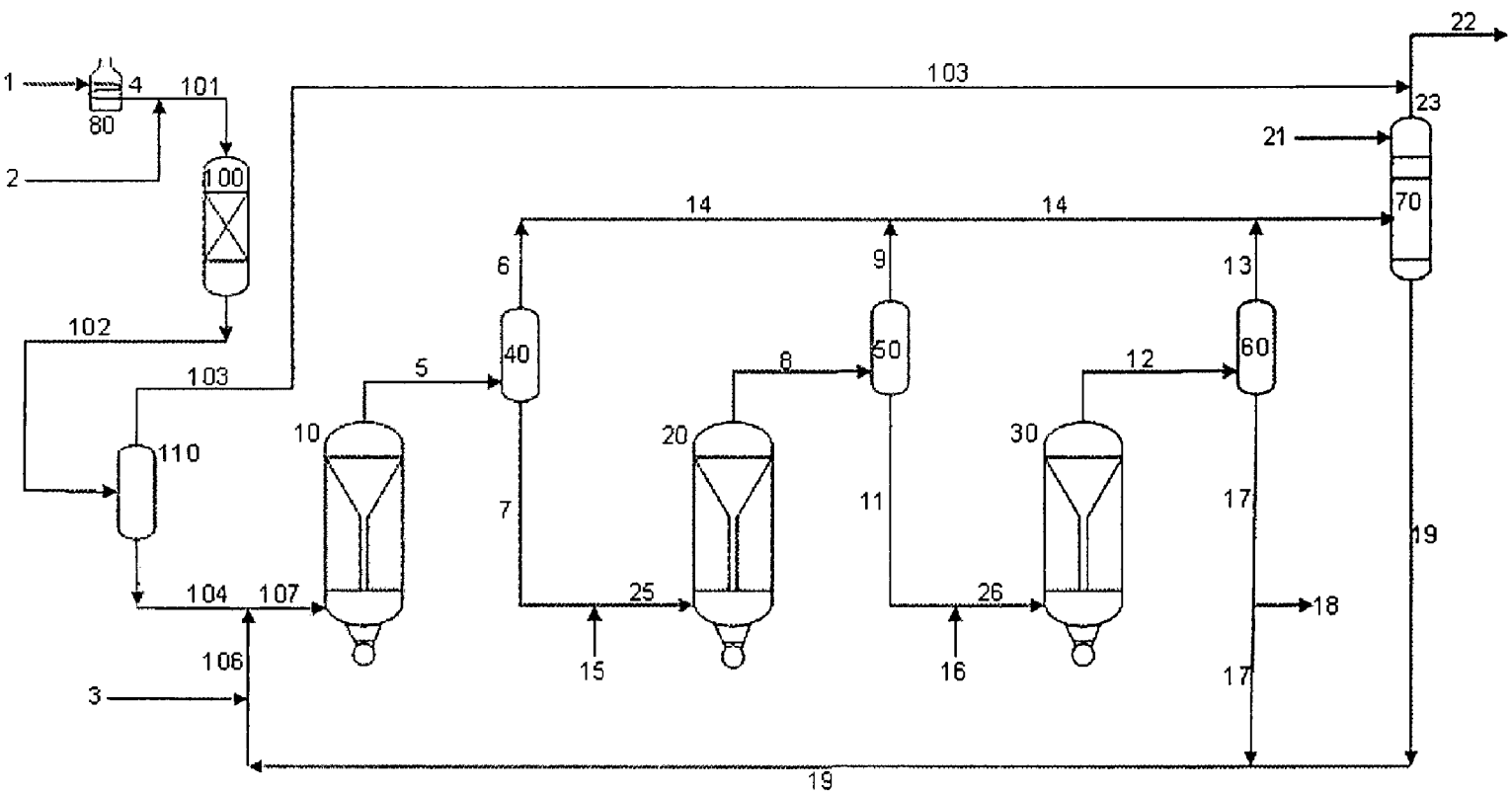

The instant invention is directed to a process for catalyst activated slurry hydro cracking with upstream in-line retreating, as depicted in the FIGURE. Stream 1 comprises a heavy feed, such as vacuum residuum. This feed enters furnace 80 where it is heated, exiting in stream 4. Stream 4 combines with a hydrogen containing gas (stream 2) resulting in a mixture (stream 101). Stream 101 enters the top of the pretreated reactor 100. The is either a fixed bed hydrotreating unit or a deasphalting unit. In a deasphalting unit, solvent generally flows countercurrent to the feed. Deasphalting is not depicted. Stream 102 leaves the bottom of the and proceeds to hot high pressure separator 110, which is preferably a flash drum. Product and hydrogen is removed overhead as a vapor stream, stream 103. Stream 103 joins with stream 22. Unconverted material exits the bottoms flash drum 110 as liquid stream 104. Stream 104 combines with stream 106. Stream 106 is composed of recycle slurry catalyst (stream 19) as well as make-up slurry catalyst (stream 3). Streams 104 and 106 combine to form stream 107.

Stream 107 enters the bottoms of up flow reactor 10, which is preferably a liquid recirculation reactor. Stream 5, a vapor stream exits the reactor overhead and comprises slurry, products, hydrogen and unconverted material. Stream 5 passes to hot high pressure separator 40, which is preferably a flash drum. Product and hydrogen is removed overhead in a vapor stream as stream 6. Liquid stream 7 is removed through the bottom of the flash drum. Stream 7 contains slurry in combination with unconverted oil.

Stream 7 is combined with a gaseous stream comprising hydrogen (stream 15) to create stream 25. Stream 25 enters the bottom of second reactor 20. Stream 8, a vapor stream comprising slurry, products, hydrogen and unconverted material, passes overhead from reactor 20 to separator 50, preferably a flash drum. Products and hydrogen are removed overhead as vapor stream 9. Liquid stream 11 is removed through the bottom of the flash drum. Stream 11 contains slurry in combination with unconverted oil.

Stream 11 is combined with a gaseous stream comprising hydrogen (stream 16) to create stream 26. Stream 26 enters the bottom of second reactor 30. Vapor stream 12 passes overhead from reactor 30 to hot high pressure separator 60, preferably a flash drum. Product and hydrogen is removed overhead as vapor stream 13. Stream 17 is removed through the bottom of the flash drum 60. Liquid stream 17 contains slurry in combination with unconverted oil. A portion of this stream may be drawn off through stream 18.

Overhead vapor streams 6, 9 and 13 create stream 14, which passes to lean oil contactor 70. Stream 22, containing a lean oil such as vacuum gas oil, enters the top portion of lean oil contactor 70 and flows downward (1) removing any possible entrained catalyst and (2) reducing heavy materials(high boiling range oil including small amounts of vacuum residue). Product and hydrogen (stream 21) exits lean oil contactor 70 as vapor overhead, while liquid stream 19 exits at the bottom. Stream 21 combines with product stream 103 to form stream 22, which is sent to hydro finishing.

Stream 19 comprises a mixture of slurry and unconverted oil. Stream 19 is combined with stream 17, which also comprises a mixture of slurry and unconverted oil. Fresh slurry is added in stream 3, and stream 106 is created. Stream 106 is combined with the feed to first reactor 10 (stream 104) to create stream 107.

The heavy product fraction is hydro finished to eliminate any remaining olefins. The hydro finisher further refines products from the slurry upgrade to high quality products by removing impurities and stabilizing the products. Greater than 99 wt % sulfur and nitrogen removal may be achieved. Reactor effluent is cooled by means of heat recovery and sent to the product recovery section as in any conventional hydro processing unit.

Conditions for retreating hydrocarbons are well known to those of skill in the art. Retreating may involve hydrotreating or deasphalting. Hydrotreating is a well-known form of feed pretreatment, and usually occurs in fixed bed hydrotreating reactors having one or more beds. Hydrotreating is generally disclosed in U.S. Pat. No. 6,890,423 and is discussed in Gary and Handwerk, *Petroleum Refining* ($2^{nd}$ ed. 1984). Typical hydrotreating conditions vary over a wide range. In general, the overall LHSV is about 0.25 to 2.0, preferably about 0.5 to 1.0. The hydrogen partial pressure is greater than 200 Pisa, preferably ranging from about 500 Pisa to about 2000 Pisa. Hydrogen recirculation rates are typically greater than 50 SCF/Bbl, and are preferably between 1000 and 5000 SCF/Bbl. Temperatures range from about 300[deg] F. to about 750[deg] F., preferably ranging from 450[deg] F. to 600[deg] F. Catalysts useful in hydrotreating operations are well known in the art. Suitable catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. The non-noble metal (such as nickel-molybdenum) hydrogenation metals are usually present in the final catalyst composition as oxides, or more preferably or possibly, as sulfides when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalyst may contain in excess of 0.01 percent metal, preferably between 0.1 and 1.0 percent metal. Combinations of noble metals may also be used, such as mixtures of platinum and palladium.

Retreating may alternately employ deasphalting, if the feed to be employed contains asphalt. Deasphalting is usually accomplished by the use of propane as a solvent, although other solvents may include lower-boiling paraffinic hydrocarbons such as ethane, butane or pentane. Deasphalting techniques are well known in the refining arts, but are discussed in the text *Petroleum Refining*. Deasphalting is disclosed generally in patents such as U.S. Pat. Nos. 6,264,826 and 5993,644.

Alternate embodiments for the slurry reactor system, which are not pictured, include a series of reactors in which one or more of the reactors contains internal separation means, rather than an external separator or flash drum following the reactor.

The process for the preparation of the catalyst slurry composition used in this invention is set forth in U.S. Ser. No. 10/938,003 and U.S. Ser. No. 10/938,202 and is incorporated by reference. The catalyst composition is useful for but not limited to hydrogenation upgrading processes such as thermal hydro cracking, hydrotreating, hydrodesulphurization, hydrodenitrification, and hydrodemetalization.

What is claimed is:

1. A process for the hydroconversion of heavy oils with a slurry, said process employing at least two upflow reactors in series with a separator in between each reactor, said process comprising the following steps:

(a) combining a heated heavy oil feed and a hydrogen gas to form a mixture;

(b) contacting the mixture at pretreating conditions in at least one pretreating reactor;

(c) passing the effluent of step (b) to a post-treating separator;

(d) passing products and hydrogen overhead from the post-treating separator and combining bottoms from the post-treating separator with an active slurry catalyst composition to form a mixture;

(e) passing the mixture of step (d) to the bottom of the first upflow reactor, which is maintained at slurry hydroconversion conditions, including elevated temperature and pressure;

(f) removing a vapor stream comprising product, hydrogen, unconverted material and slurry catalyst overhead from the first reactor and passing it to a separator;

(g) in the separator of step (f), removing a vapor stream comprising product and hydrogen overhead to further processing and passing a liquid bottoms stream, comprising unconverted material and slurry catalyst, to the bottom of the second upflow reactor, which is maintained at slurry hydroconversion conditions, including elevated temperature and pressure;

(h) removing a vapor stream comprising product and hydrogen, unconverted material and slurry catalyst overhead from the second reactor and passing it to a second separator;

(i) in the second separator, removing a vapor stream comprising products and hydrogen overhead to further processing and passing a liquid bottoms stream, comprising unconverted material and slurry catalyst to further processing.

2. The process of claim 1, wherein the pretreating reactor is selected from the group consisting of a hydrotreating reactor or a deasphalting reactor.

3. The process of claim 2, wherein the hydrotreating reactor is a fixed bed reactor which comprises at least one catalyst bed of hydrotreating catalyst.

4. The process of claim 1, in which a pretreating process employing deasphalting uses solvents selected from the group consisting of ethane, propane, butane and pentane.

5. The process of claim 1, wherein pretreating conditions further comprise those suitable for hydrotreating.

6. The process of claim 5, wherein hydrotreating conditions further employ temperatures in the range from 300 and 750 F., space velocities in the range from 0.25 to 2 LHSV, pressures in the range from 500 to 2000 psia and hydrogen recirculation rates are between 1000 and 5000 SCF/Bbl.

7. The process of claim 1, wherein a pretreating process employing hydrotreating uses a catalyst comprising a metal selected from Group VIIIA or Group VIB.

8. The process of claim 7, wherein Group VIII metals are selected from the group consisting of platinum or palladium on an alumina or siliceous matrix.

9. The process of claim 1, wherein the bottoms material of step (g) is recycled to step (a), the mixture of step (a) further comprising recycled unconverted material and slurry catalyst.

10. The process of claim 1, wherein the bottoms material of step (g) is passed to the bottom of a third reactor which is maintained at slurry hydroconversion conditions, including elevated temperature and pressure.

11. The process of claim 1, in which a liquid recirculating reactor is employed in at least one of the reactors.

12. The process of claim 10, in which the recirculating reactor employs a pump.

13. The process of claim 1, in which hydroprocessing conditions employed in each reactor comprise a total pressure in the range from 1500 to 3500 psia and a reaction temperature of from 700 to 900 F.

14. The process of claim 13, in which hydroprocessing conditions employed in each reactor comprise a total pressure in the range from 2000 to 3000 psia and a reaction temperature of from 775 to 850 F.

15. The process of claim 1, wherein the separator located between each reactor is a flash drum.

16. The hydroconversion process of claim 1, wherein the heavy oil is selected from the group consisting of atmospheric rediuum, vacuum residuum tar from a solvent deasphalting unit, atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers.

17. The hydroconversion process of claim 1, wherein the process is selected from the group consisting of hydrocracking, hydrotreating, hydrodesulphurization, hydrodenitrification, and hydrodemetalization.

18. The process of claim 1, wherein the active slurry catalyst composition of claim 1 is prepared by the following steps:

(a) mixing a Group VIB metal oxide and aqueous ammonia to form a Group VI B metal compound aqueous mixture;

(b) sulfiding, in an initial reaction zone, the aqueous mixture of step (a) with a gas comprising hydrogen sulfide to a dosage greater than 8 SCF of hydrogen sulfide per pound of Group VIB metal to form a slurry;

(c) promoting the slurry with a Group VIII metal compound;

(d) mixing the slurry of step (c) with a hydrocarbon oil having a viscosity of at least 2 cSt @ 212° F. to form an intermediate mixture;

(e) combining the intermediate mixture with hydrogen gas in a second reaction zone, under conditions which maintain the water in the intermediate mixture in a liquid phase, thereby forming an active catalyst composition admixed with a liquid hydrocarbon; and (f) recovering the active catalyst composition.

19. The process of claim 1 in which at least 90 wt % of feed is converted to product.

* * * * *